US005405243A

United States Patent [19]

Hurley et al.

[11] Patent Number: 5,405,243

[45] Date of Patent: Apr. 11, 1995

[54] PROPELLER WITH SHROUDING RING ATTACHED TO BLADE

[75] Inventors: Norman R. Hurley; Russell D. Mirfin; Rhys W. Morgan; Michael B. Tunstill, all of Gold Coast, Australia

[73] Assignee: Stealth Propulsion Pty. Ltd., Australia

[21] Appl. No.: 98,372

[22] PCT Filed: Dec. 16, 1991

[86] PCT No.: PCT/AU91/00582

§ 371 Date: Aug. 12, 1993

§ 102(e) Date: Aug. 12, 1993

[87] PCT Pub. No.: WO92/10402

PCT Pub. Date: Jun. 25, 1992

[30] Foreign Application Priority Data

Dec. 14, 1990 [AU] Australia ..... PK3881

[51] Int. Cl.[6] ..... B63H 1/16

[52] U.S. Cl. ..... 416/189; 416/191; 416/237; 416/247 A

[58] Field of Search ..... 416/189, 191, 194, 195, 416/228, 237, 247 A

[56] References Cited

U.S. PATENT DOCUMENTS

| | | | |
|---|---|---|---|
| 834,624 | 10/1906 | Littlejohn | 416/191 |
| 855,131 | 5/1907 | Preidel | 416/189 R |
| 1,438,012 | 12/1922 | Bauer . | |
| 3,224,509 | 12/1965 | Thompson . | |
| 4,331,429 | 5/1982 | Koepsel et al. | 416/93 A |
| 4,505,641 | 3/1985 | Tsuchikawa et al. | 416/189 R |
| 4,836,748 | 6/1989 | Church | 416/189 R |

FOREIGN PATENT DOCUMENTS

| | | | |
|---|---|---|---|
| 101243 | 6/1937 | Australia . | |
| 597273 | 11/1925 | France . | |
| 126288 | 7/1983 | Japan | 416/247 A |
| 16201 | 1/1889 | United Kingdom | 416/237 |
| 9582 | 4/1912 | United Kingdom | 416/189 R |
| 9107313 | 5/1991 | WIPO . | |

*Primary Examiner*—Edward K. Look
*Assistant Examiner*—James A. Larson
*Attorney, Agent, or Firm*—Hoffman, Wasson & Gitler

[57] ABSTRACT

A propeller having a central hub portion with multiple blades affixed to the hub portion and spaced around the circumference of the hub to extend outwardly therefrom is provided. An annular ring or shroud joins the tips of the blades, a portion of each blade tip being free of the annular ring on the trailing side of the blade to define a region permitting outward flow of liquid along the blades. By this construction, energy is directed rearwardly from the propeller and the loss of energy due to centrifugal action is reduced.

19 Claims, 3 Drawing Sheets

PROPELLER WITH SHROUDING RING ATTACHED TO BLADE

TECHNICAL FIELD

THIS INVENTION relates to improvements to propellers and in particular to improved marine propellers.

BACKGROUND ART

Many different propeller constructions have been proposed in the past and are presently available. Some propellers which have been proposed incorporate a ring or shroud which surrounds the propeller let blades and is fixed thereto so as to be rotatable with the blades. The aim of such shrouds is to direct energy rearwardly from the propeller, rather than losing energy as a result of centrifugal action. Such propellers have not proved particularly effective and often have substantially decreased efficiency compared to normal unshrouded propellers. In particular, excessive pressure can build up within the ring and furthermore, viscous drag which occurs about the ring as it rotates builds up a rotational boundary layer about the ring increasing the effective drag area of the propeller.

Other propellers have been provided with tip or end plates at the end of the propeller blades for distributing the vortices from the blades so that minimum kinetic energy losses occur. Current tip and end plate designs have had limited success.

DISCLOSURE OF THE INVENTION

The present invention aims to overcome or alleviate the above disadvantages by providing in one aspect an improved ring-type propeller, particularly suited to marine applications which has greater efficiency than known ring propellers and substantially the same efficiency as conventional propellers whilst retaining the benefits of a ring shrouding the propeller blades. The present invention in a further aspect aims to provide a propeller having tip or end portions at the ends or tips of the propeller blades which functions more efficiently than propellers having known tip or end plate configurations. Other objects and advantages of the invention will become apparent from the following description.

The present invention thus provides in a first aspect a propeller having a central hub portion, a plurality of blades fixed to said hub portion and spaced therearound to extend outwardly of said hub portion, an annular ring or shroud joining the tips of said blades, a portion of each said blade tip being free of said annular ring on the trailing side of said blade to define a region permitting outward flow of liquid along said blades.

Preferably, each said region of said ring is adjacent the trailing edge of said blade.

The trailing edge of said ring suitably intersects each blade at a relief point intermediate the leading and trailing edges of the blade tip and follows the profile of the blade tip from said relief point to or adjacent the trailing edge of said blade tip.

Preferably, the ring tapers in its dimension axially of said propeller from a maximum at said trailing edge of each blade to a minimum at the relief point.

The ring on the leading side of said blade preferably joins said blade tips along the full width thereof.

The region free of the ring may be defined by a slot in the ring, the s lot being bounded on one side by the tip of the blade.

In a second aspect, the present invention provides a propeller having a central hub portion, a plurality of blades fixed to said hub portion and spaced therearound to extend outwardly of said hub portion, said blades having at their free tips, end portions on opposite sides of said blades and extending generally axially of said propeller, a portion of each said blade tip being free of said end portions on the trailing side of said blade to define a region permitting outward flow of liquid along said blades, said blade tip being joined to said end portions along the full width thereof on the leading said of said blade.

Preferably, said end portion on the trailing side of each blade is joined to said blade tip up to a relief point. said region being disposed between said relief point and the trailing edge of the blade.

Propellers according to the present invention have a similar external diameter (D) to the diameter of a conventional open propeller. Most preferably the diameter is in the range of ninety-two percent to ninety-six percent of an open propeller.

Preferably the pitch/diameter ratio ranges from 1.8 for higher speed and planing vessel propellers to 0.8 for lower speed displacement craft.

The pitch of the blades of the propeller may be constant along their length which will give top speeds comparable with the speeds obtainable with an open B series propeller. Overall, however, blades with a variable face pitch with pitch diminishing from the root of the blade(at the hub) to the tip of the blade provides better characteristics through a range of speeds. In a particular preferred form the pitch of the blade face adjacent the tip is eighty-five percent of the pitch of the blade face adjacent to the hub (root), however, the pitch at the tip may be varied from eighty percent of the pitch at the hub to the same pitch as at the hub (constant pitch) in the preferred embodiment the pitch of the blades at the tips is between 80 and 100 percent of the pitch adjacent the hub portion.

The propeller of the invention may have any number of blades ranging from two upwards, however, practically two to six blades prove most efficient.

For higher surface speeds Such as for outboard applications disc area ratios between 0.38 and 0.45 perform best, however for special applications and for displacement craft lower or higher ratios can be utilized.

In most outboard configurations the hub diameter ratio has a set mean which is enforced by the need to exit exhaust gases through the hub. Similar ratios are employed in the propellers of the invention. In non exhaust vent hubs however, the propeller may have a hub of smaller diameter and mass as allowed by the additional structural integrity imparted to the blade hub connection by the support of the blades by the annular ring or shroud. Smaller diameter hubs permit blade areas in a given diameter to be increased by up to five percent thereby reducing water pressures on the pressure side of the blades assisting to further reduce cavitation.

The mean width ratio of the propellers fall within known parameters for conventional open and shrouded propellers. In cross-section, the blades of the propeller preferably have lower chord ratios than conventional propeller ratios. In some forms the blades may in cross-section have parallel faces whilst for higher rotational speeds, blades with a general wedge shaped cross-section with the widest section being the trailing edge are advantageous.

In propellers according to the invention wherein the blades are supported by the annular ring or shroud the blade thickness may be reduced because of the reduced need for cantilever strength due to the support of the tips by the ring. The blade thickness fractions thus may be in the range of 0.03 to 0.045.

Blades contours can differ from most conventional open propellers and can be parallel sided or varying in width from root to tip. Where, however, an annular ring or shroud is used the width of the blade tip at its connection to, or intersection with the ring is most preferably not less than fifty-five percent (55%) of the maximum blade width.

As with conventional propellers the skew of the blades falls within the general design rules, that is no skew for lower rotational and surface speed propellers to five percent of skew for higher surface and rotational speed.

A blade rake angle of zero degrees is suited to low speed (displacement vessel ) operations whereas for higher speeds (planing vessels), it is preferred to have a positive blade rake of up to twenty-eight degrees to minimize the drag effects created by the rotational boundary layers generated by the annular ring or tips due to viscous drag.

The annular ring of the propeller where used reduces viscous drag and allows rotational speeds similar to that of conventional open propellers. This is important with outboard motor applications as maximum power and torque values are obtained at near maximum engine RPM. The annular ring is shaped to provide minimum viscous drag as presented to the water flow and by variance of width profile reduces the rotational boundary layers as encountered in current ring propellers. Similar advantages result where the ring is truncated adjacent the leading and trailing edges of the blades to form tip portions. Such tip portions function in a similar manner to the ring type propellers of the invention to permit water escape along the blade and break up of rotational boundary layers.

Maximum ring length, that is length of the ring in the axial direction of the propeller is dictated by the type of vessel and the speed requirements for that vessel. Generally propellers for slower craft (sub-planing) will have higher ratios of ring length to diameter than propellers for higher speed (planing) craft. Preferably, such ratios fall between 0.25 in the upper end, (e.g. tug boat or ice breaker) to 0.1 (e.g. ski boat or hydroplane).

Minimum length of ring is dictated by the selection of the pressure relief point chosen for the particular duty of that propeller, the pressure relief point being that point along the line of intersection of the blade with the ring rearwardly of which, the blade tip is not encompassed by the ring. Such a point, as described, may be defined by a total or partial removal of a section of the annular ring either as a slot or tip blade type ring profile. Such a relief point is usually less than 0.5 blade width at its intersection and attachment face to the ring from the trailing edge of the blade. By moving the relief point rearwards and increasing the amount of the blade tip encompassed by the ring or tip portion, the discipline imposed on the water race is increased. This increases the thrust capability of the device at lower speeds and is important for high bollard pull applications.

The positioning of this relief point further defines the amount viscous drag penalty, and it is an important feature of the device when determining off-standard designs. The relief point however may be positioned anywhere between the leading and trailing edges of the blade.

The cross section shape of the ring varies with the duty performance required by the propeller as matched to the vessel. The ring may have an external face along its length which is angled or parallel to the central axis. The ring may also have an external foil or ogival shape.

The internal profile of the ring length may be of foiled shape, have leading or trailing edge relief tapers or curved faces parallel or angled to the centre axis. The ring may also have parallel outer and inner faces which are angled to the central axis of the hub. The leading edge of the ring may be rounded or tapered to a point with either or both internal and external relief angles. The trailing edge may be rounded, tapered, square or feathered to a point.

The maximum point of ring thickness is preferably between 0.015 and 0.035 ring diameter The hub may be parallel or tapered to the central axis and most usually be of a length between 1.65 times hub diameter for exhaust vented hubs and a minimum of 0.6 for conventional hubs.

At the trailing edge, the hub may exhibit a profile of constant cross section or be developed conically or flared outwardly in an alternative manner so as to increase in diameter. This increase will usually be to a maximum of 1.1125 times the average cross section of the hub. The conical or flared development will usually commence at a point not greater than 20% of the hub length when measured from the trailing edge. This conical or flared development will assist in extending the disciplined section of the water race avoiding premature disintegration.

BRIEF DESCRIPTION OF THE DRAWINGS

In order that the invention may be more readily understood and put into practical effect, reference will now be made to accompanying drawings which illustrate a preferred embodiment of the invention and wherein.

DETAILED DESCRIPTION OF MODES FOR CARRYING OUT THE INVENTION

Figure 1:
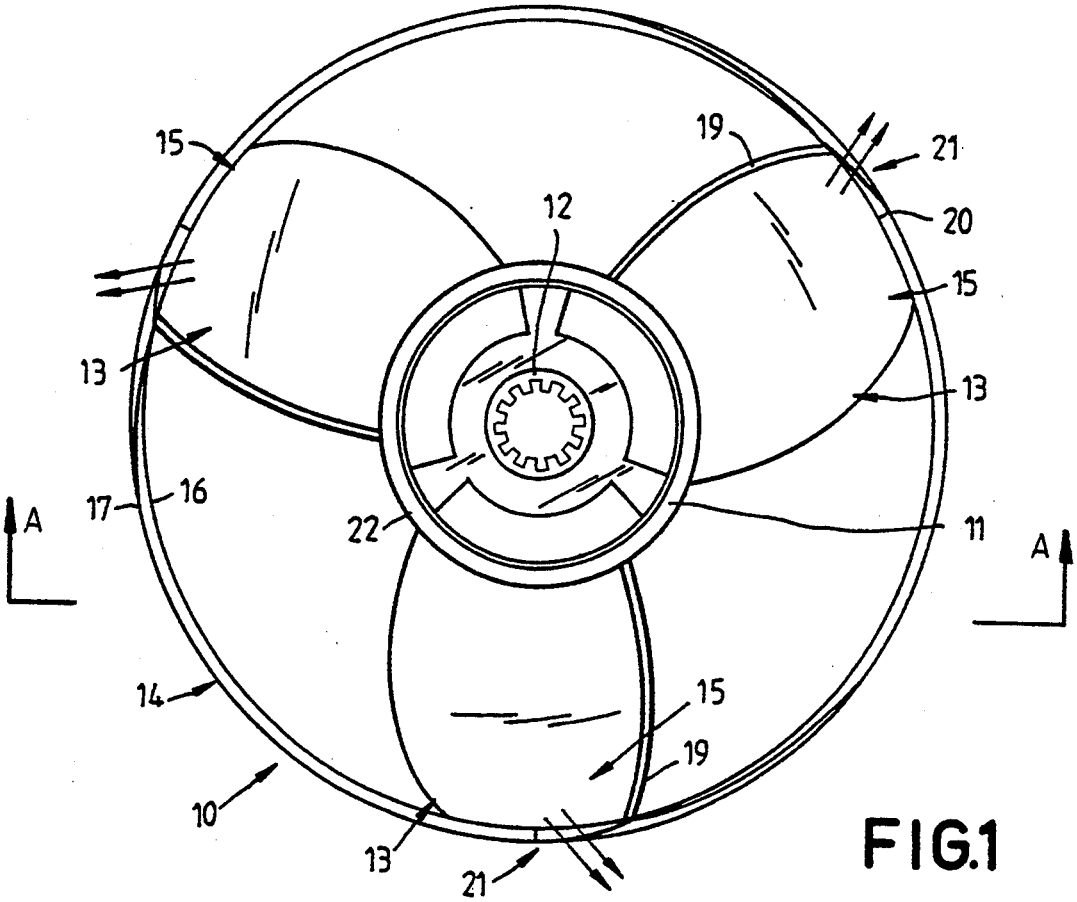
FIG. 1 is a plan view of a propeller according to the present invention.

Referring to the drawings and firstly to FIGS. 1 to 4 there is illustrated a propeller 10 according to the present invention including a central hub 11 of generally cylindrical form and including a splined sleeve 12 so as to enable the propeller to be mounted to the splined driving shaft of a drive motor, for example an outboard motor. The hub 11, of course may be provided with any means known in the art to enable it to be mounted to a drive shaft such as by means of a pin extending diametrically through the hub and shaft.

Fixed to the hub 11 and extending outwardly therefrom are a plurality of blades 13, in this instance three which may be either formed integrally with the hub 11, for example by being cast therewith or secured to the hub 11 by welding or other means. In this embodiment and is more apparent in FIG. 4, the blades 13 have a varying pitch from root to tip, and curved leading and trailing edges which taper to the tip of the blades 13, An annular shroud 14 of ring shaped form is arranged concentrically with the hub 11 and fixed or joined to the outer ends or tips 15 of the blades 13, the shroud 14 again either being formed integrally with the blades 13 or secured thereto for example by welding. The inner wall 16 of the shroud 14 in this embodiment is curved as is the outer wall 17, the walls thereby tapering towards the leading end of the propeller let in the manner shown in FIG. 4. The shroud 14, however, may have cylindrical outer and inner walls so as to be of constant cross section or be of other cross sectional form as referred to above.

Figure 2:
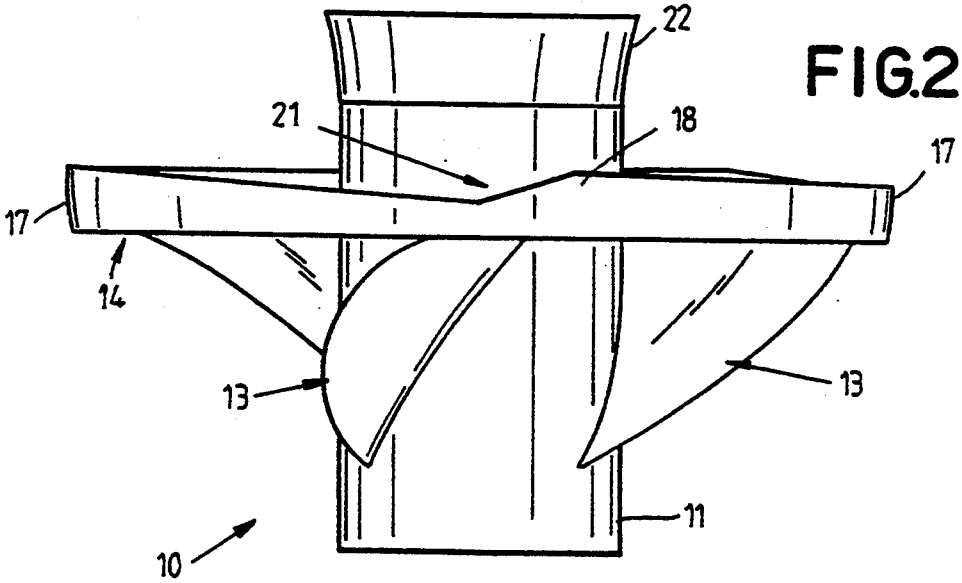
FIG. 2 is a side elevational view of the propeller of FIG. 1.
Figure 3:
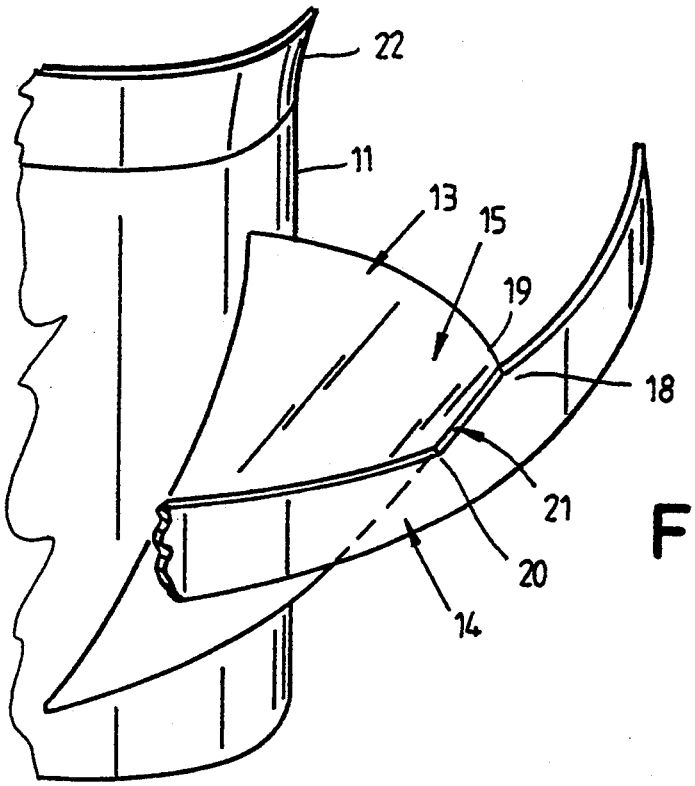
FIG. 3 is a perspective view illustrating portion of the shroud and associated propeller blade of the propeller.
Figure 4:
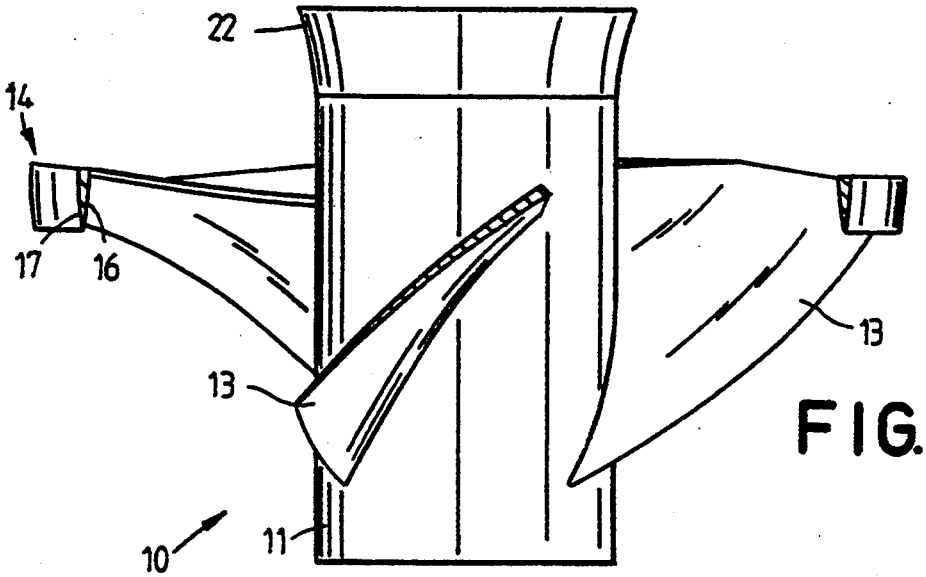
FIG. 4 is a sectional view of the propeller along line A—A of FIG. 1.

As shown more clearly in FIGS. 2 and 3 the shroud 14 varies in width, tapering from a maximum at 18 adjacent the trailing edge 19 of the blade 13 at its junction with the shroud 14 to a minimum at a relief point 20 where it intersects the next blade 13 at its tip 15 and preferably intermediate the leading and trailing ends of the tip 15. In this embodiment, the relief point 20 is approximately half way between the leading and trailing edges of the tip 15. The shroud 14 from this point 20 then follows the profile of the blade tip 15 to the trailing end 19 of the blade 13 where it is at a maximum depth 18. This arrangement therefor forms a region 21 for water to escape from the blades in the direction of the arrows shown in FIGS. 1 and 3. Forwardly of this region 21 the tip 15 is encompassed by the shroud 14.

On the opposite or low pressure side of the blades 13, the ring or shroud 14 encompasses the blade tip 15 along the full line of intersection from the leading to the trailing edges of the blade tip 15.

The hub 11 of the propeller 10 includes on its trailing side an outwardly flared portion 22 which is of curved form in this embodiment but which may be conical or outwardly divergent in any other manner. The flared portion 22 provides for further guided movement of water rearwardly of the propeller 10 upon rotation thereof.

Upon rotation, and on the high pressure or trailing side of the blades 13, the region 21 relieves build up of pressure within the ring 14 by permitting outward flow of water as indicated by the arrows in FIGS. 1 to 3. Additionally, water escaping outwardly through the region 21 breaks up the rotational boundary layer about the ring 14 thereby reducing the effective diameter of the propeller 10 so as to reduce drag. Forwardly of the region 21, the ring or shroud 14 distributes the free vortices at the blade tip. On the low pressure or leading side of the blades 13, the ring 14 constrains the water flow to concentrate the low pressure area along the full width of the blade tip 15 to thereby increases thrust.

The shroud 14 also serves, as well as an annular support to the blades 13, as a safety device so that the tips 15 of the blades 13 are not exposed. Thus damage to marine life will be substantially reduced, and similarly the risks of damage to persons struck inadvertently by such a propeller 10 will also be reduced.

Figure 5:
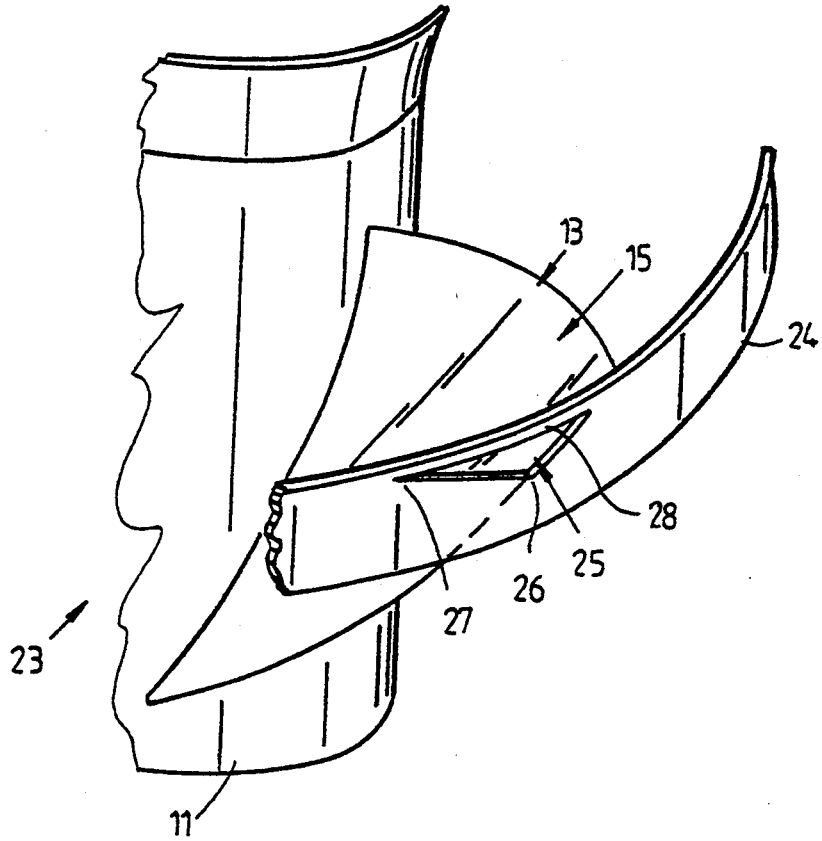
FIG. 5 is a perspective view illustrating portion of a further form of propel let according to the invention incorporating an alternative ring.

Referring now to FIG. 5, there is illustrated a further form of propeller 23 according to the invention in which like components to that of the embodiment of FIGS. 1 to 4 have been given like numerals. The propeller 23 includes as previously a central hub portion 11 and a plurality of blades 13 extending outwardly from the hub portion 11 and terminating in an annular ring or shroud 24 which joins the tips of the blades 13. A portion of the annular ring 24 adjacent the tip of each blade 13 is slotted as at 25, the slot 25 extending along the line of intersection between the blade tip 15 and the ring 24 so that one side of the slot 25 is bounded by or aligned with the blade tip 15. The slot 25 is located on the trailing or high pressure side of the blades 13 and extends rearwardly from a relief point 26 approximately midway between the leading and trailing edges of the blades 13. In this embodiment the slot 25 tapers forwardly to a leading point 27 and leaves an annular connecting portion 28 to retain the structural rigidity of the ring 24. The slot 25 functions in the same manner as the region 21 of the embodiment of FIGS. 1 to 4, to provide a region through which liquid may flow upon rotation of the propeller 23 to relieve ring pressure and break up the boundary layer. On the leading side, the full width of the blade tip 15 is encompassed by the ring 24 to concentrate the low pressures as described above.

Figure 6:
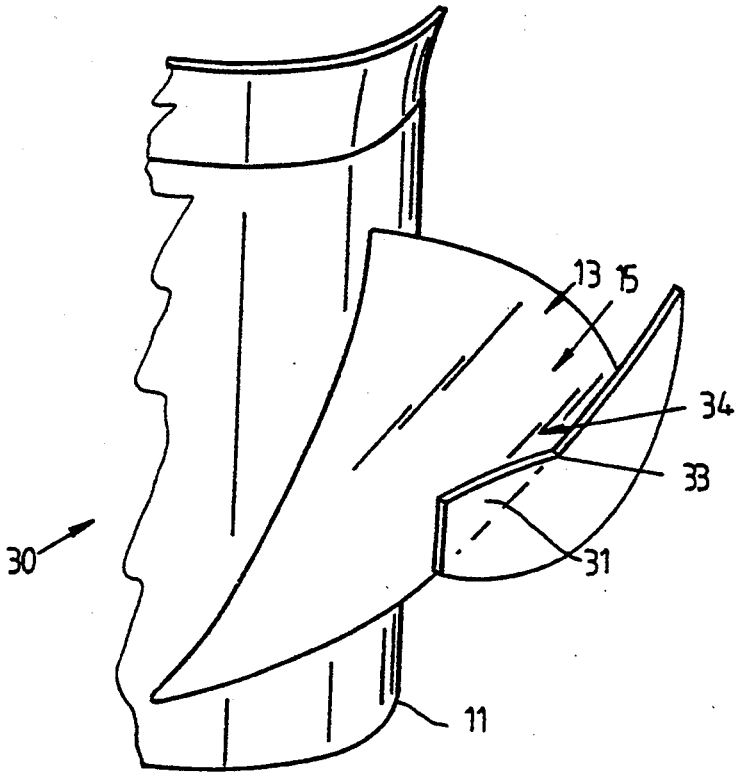
FIG. 6 is a perspective view illustrating portion of yet an alternative form of propeller according to the invention incorporating tips portions.

Referring now to FIG. 6, there is illustrated a further embodiment of propeller 30 according to the present invention in which again like components to the components of the propeller of FIGS. 1 to 4 have been given like numerals. The propeller 30 includes a central hub portion 11 and a plurality of blades 13 fixed to the hub portion 11 to extend outwardly therefrom and provided at their free ends with tip end portions 31 and 32 which extend generally in an axial direction of the propeller 10. The end portions 31 and 32 may be considered to be equivalent to sections of the annular ring 14 of FIGS. 1 to 4 which has been truncated adjacent the leading and trailing edges of the blade tips 15. The tip end portions 31 and 32 are provided on the trailing and leading sides of the blades 13 respectively with the portions 31 on the trailing side extending from the leading edge of the blade tip 15 and terminating at relief point 33 at the blade tip 15 so that portion of the blade tip 15 trailing the relief point 33 forms a region 34 for outward flow of fluid in the manner described in the embodiments of FIGS. 1 to 5. On the leading side of the blades 15, the tip end portion 32 extends along the full chord length of the blade tip 15 to concentrate low pressures and increase thrust as al so described above, The propellers of the invention may be formed of any suitable material with particular preferred materials being cast aluminium or moulded plastics. The use of the rings makes the propellers particularly suited for manufacture from plastics such as by an injection moulding technique as the blades may be of thinner cross section as the ring provides sufficient structural rigidity. This permits less material to be used thereby reducing cost of manufacture and increasing production efficiency. The rings of course may also extend beyond the blades in an axial direction to the trailing and/or leading side of the blades provided that a region on the trailing side is left open for outward passage of water as described.

Whilst the above has been given by way of illustrative embodiment of the invention, all such modifications and variations thereto as would be apparent to persons skilled in the art are deemed to fall within the broad scope and ambit of the invention as herein set forth.

We claim:

1. A propeller having a central hub portion, a plurality of blades fixed to said hub portion and spaced therearound to extend outwardly of said hub portion, each of said blades having a leading side, a trailing side, an outer tip and leading and trailing edges, an annular ring or shroud concentric with said hub portion joining said tips of said blades, said ring having a leading edge and trailing edge, said trailing edge intersecting each said blade at a relief point on the trailing side of said blade, said relief point being located intermediate said leading edge and said trailing edge of said blade at said blade tip, said trailing edge of said ring following the profile of each said blade tip from said relief point to trailing edge of said blade tip so as to define a region permitting outward flow of liquid along said trailing side of each said blade, said ring tapering in width axially of said propeller from a maximum adjacent said trailing edge of each said blade to a minimum at said relief point of each adjacent blade.

2. A propeller according to claim 1 wherein said ring on the leading side of said blade joins said blade tips along the full width thereof.

3. A propeller according to claim 1 wherein the width of said blades at said tip is not less than 55% of the maximum width of said blades.

4. A propeller according to claim 1 wherein the pitch of said blades diminishes from a maximum adjacent said hub portion to a minimum at said tips 5. A propeller according to claim 1 wherein the pitch of said blades at said tips is between 80% and 100% of the pitch adjacent said hub portion.

6. A propeller according to claim 1 wherein said hub portion includes on its trailing end an outwardly flared portion.

7. A propeller according to claim 1, wherein said ring tapers in thickness towards a leading end of said propeller.

8. A propeller according to claim 7, wherein said ring has inner and outer curved faces.

9. A propeller according to claim 1, wherein a maximum width of said ring between said leading and trailing edges is between 0.1 and 0.25 of its diameter.

10. A propeller according to claim 1, wherein said propeller has a pitch to diameter ratio in a range of 0.8 to 1.8.

11. A propeller having a central hub portion, an axis of rotation, and a plurality of blades fixed to said hub portion and spaced therearound to extend outwardly of said hub portion, each said blade having a leading side, a trailing side, an outer tip and leading and trailing edges said blades having at their tips, end portions extending on opposite sides of said blades relatively to said axis of said propeller, each said end portion having a trailing edge intersecting said blade at a relief point on said trailing side of said blade, said relief point being disposed between said leading and trailing edges of said blade at its tip, said trailing edge of said end portion following a profile of said blade on said trailing side thereof from said relief point to the trailing edge of said blade to define a region permitting outward flow of liquid along the trailing side of each said blade, said end portion extending away from said blade in an axial direction along a full width of said blade tip on said leading side of said blade.

12. A propeller having a central hub portion, a plurality of blades fixed to said hub portion and spaced therearound to extend outwardly of said hub portion, each said blade having a leading side, a trailing side, an outer tip, and leading and trailing edges an annular ring concentric with said hub portion joining said tips of said blades, said ring having a leading edge and a trailing edge, each said tip intersecting said ring between said leading and trailing edges of said ring, an aperture formed through said ring adjacent each said blade tip on the trailing side of said blade, said aperture extending along said blade tip from a relief point on said trailing side of said blade intermediate said leading and trailing edges of said blade at said blade tip, and following a profile of said blade tip from said relief point towards said trailing edge of said blade tip so as to define a region permitting outward flow of liquid along said trailing side of each said blade.

13. A propeller according to claim 12, wherein said blades have a pitch diminishing from a maximum adjacent said hub portion to a minimum adjacent said tips.

14. A propeller according to claim 12, wherein each said aperture defines adjacent said trailing edge of said ring a part annular member defining one side of said aperture.

15. A propeller according to claim 14, wherein each said aperture tapers in width from said relief point in a direction circumferentially of said ring.

16. A propeller having a central hub portion, a plurality of blades fixed to said hub portion and spaced therearound to extend outwardly of said hub portion, each said blade having a leading side, a trailing side, an outer tip, and leading and trailing edges an annular ring concentric with said hub portion joining said tips of said blades, said ring having a leading edge and trailing edge, each said tip joining said ring along a full width of said tip on said leading side of said blade between said leading and trailing edges of said ring, said trailing edge of said ring intersecting each said blade tip on said trailing side of said blade at a relief point located intermediate said leading and trailing edges of said blade at said tip and following a profile of said blade on said trailing side thereof from said relief point towards said trailing edge of said blade at said tip to define a region permitting outward flow of liquid along said trailing side of each said blade.

17. A propeller according to claim 16, wherein said blades have a pitch diminishing from a maximum adjacent said hub portion to minimum adjacent said tips.

18. A propeller according to claim 16, wherein said ring tapers in width from said trailing edge of one said blade to said relief point of an adjacent blade.

19. A propeller according to claim 16, wherein said ring tapers in thickness towards a leading end of said propeller.

* * * * *